US005987288A

United States Patent [19]

Mori et al.

[11] Patent Number: 5,987,288

[45] Date of Patent: Nov. 16, 1999

[54] IMAGE FORMING APPARATUS HAVING A PLURALITY OF MAGNETIC DEVELOPING ROLLERS

[75] Inventors: Shingo Mori; Shuichi Kadota, both of Osaka, Japan

[73] Assignee: Mita Industrial Co., Ltd., Osaka, Japan

[21] Appl. No.: 09/188,414

[22] Filed: Nov. 10, 1998

[30] Foreign Application Priority Data

| | | | |
|---|---|---|---|
| Nov. 27, 1997 | [JP] | Japan | 9-325585 |
| Nov. 27, 1997 | [JP] | Japan | 9-325586 |
| Nov. 27, 1997 | [JP] | Japan | 9-325587 |
| Nov. 27, 1997 | [JP] | Japan | 9-325588 |

[51] Int. Cl.[6] ..... G03G 15/06; G03G 15/09

[52] U.S. Cl. ..... 399/269; 399/272; 399/273

[58] Field of Search ..... 399/269, 267, 399/272, 273, 274, 277; 430/122

[56] References Cited

U.S. PATENT DOCUMENTS

| | | | |
|---|---|---|---|
| 4,436,055 | 3/1984 | Yamashita et al. | 399/269 |
| 4,442,790 | 4/1984 | Swapceinski et al. | 399/269 |
| 4,766,458 | 8/1988 | Oka et al. | 399/274 X |
| 5,065,192 | 11/1991 | Adkins et al. | 399/273 |
| 5,416,571 | 5/1995 | Yamada et al. | 399/269 |
| 5,630,201 | 5/1997 | Suzuki et al. | 399/269 |
| 5,832,350 | 11/1998 | Kumasaka et al. | 399/272 X |

*Primary Examiner*—Joan Pendegrass
*Assistant Examiner*—Sophia S. Chen
*Attorney, Agent, or Firm*—Smith, Gambrell & Russell, LLP

[57] ABSTRACT

An apparatus for developing an electrostatic latent image includes a first developing agent application device and a second developing agent application device disposed facing the peripheral surface of a photosensitive material drum, a developing agent stirring/conveying mechanism for conveying the developing agent to the first developing agent application device, a magnetic conveyer disposed at the back of the second developing agent application device, and a developing agent return guide plate for sending the developing agent conveyed by the magnetic conveyer to the side of the developing agent stirring/conveying mechanism. The second developing agent application device is provided with a developing agent-peeling zone where magnetic poles of the same polarity are magnetized neighboring each other on the upstream side of the position which is closest to the sleeve member of the magnetic conveyer in the direction of rotation. The magnetic conveyer has a magnetic pole at a position facing the developing agent-peeling zone. The magnetic pole has a polarity opposite to that of the polarity of the magnetic poles forming the developing agent-peeling zone.

9 Claims, 5 Drawing Sheets

IMAGE FORMING APPARATUS HAVING A PLURALITY OF MAGNETIC DEVELOPING ROLLERS

FIELD OF THE INVENTION

The present invention relates to an apparatus for developing an electrostatic latent image into a toner image in an image-forming machine such as an electrostatic copier or a laser-type printer. More specifically, the invention relates to an apparatus for developing an electrostatic latent image, which is equipped with a plurality of developing agent application means for applying a developing agent comprising carrier particles and a toner onto the electrostatic latent image formed on the peripheral surface of a photosensitive material drum.

DESCRIPTION OF THE PRIOR ART

In an image-forming machine such as an electrostatic copier or a laser-type printer, as is widely known, an electrostatic latent image is formed on the peripheral surface of a photosensitive material drum and is developed into a toner image. The developing is executed by applying a developing agent onto the peripheral surface of the photosensitive material drum using a developing agent application means at the time when the peripheral surface of the photosensitive material drum moves via a developing zone. To meet an increase in an image-forming speed, there have been heretofore proposed apparatuses for developing an electrostatic latent image having a plurality of developing agent application means for reliably applying the developing agent onto the peripheral surface of the photosensitive material drum. For example, Japanese Unexamined Patent Publications (Kokai) Nos. 68364/1985 and 31876/1991 disclose apparatuses for developing an electrostatic latent image equipped with two developing agent application means. According to the apparatuses for developing electrostatic latent images disclosed in these publications, provision is made of a first developing agent application means disposed in a developing zone facing to the peripheral surface of the photosensitive material drum, and a second developing agent application means disposed on the upstream side of the peripheral surface of the photosensitive material drum relative to the first developing agent application means in the moving direction, i.e., on the upper side of the first developing agent application means facing to the peripheral surface of the photosensitive material drum, and a developing agent comprising carrier particles and a toner is applied onto the peripheral surface of the photosensitive material drum by the two developing agent application means to develop an electrostatic latent image into a toner image.

More detailedly, the first developing agent application means in the above-mentioned apparatus for developing an electrostatic latent image is constituted by a first sleeve member that is driven to rotate and a first magnet means disposed in the first sleeve member. The second developing agent application means, too, is constituted by a second sleeve member that is driven to rotate and a second magnet means disposed in the second sleeve member, like the first developing agent application means. The first sleeve member has a peripheral surface that moves in the forward direction in the developing zone relative to the motion of the peripheral surface of the photosensitive drum, and the second sleeve member has a peripheral surface that moves in an opposite direction in the developing zone relative to the motion of the peripheral surface of the photosensitive material drum. This apparatus for developing an electrostatic latent image is further provided with a developing agent stirring/conveying mechanism. The developing agent stirred and conveyed by the developing agent stirring/conveying mechanism is magnetically adsorbed to, and held by, the peripheral surface of the first sleeve member that constitutes the first developing agent application means. Then, part of the developing agent adsorbed to, and held by, the peripheral surface of the first sleeve member is transferred onto the peripheral surface of the second sleeve member that constitutes the second developing agent application means and is magnetically adsorbed thereto, and held thereby, and is then applied to the peripheral surface of the photosensitive material drum in the developing zone. Furthermore, the developing agent that has not been transferred to the peripheral surface of the second sleeve member but has been maintained held by the peripheral surface of the first sleeve member is also applied to the peripheral surface of the photosensitive material drum in the developing zone.

It is important that the remaining developing agent still held by the peripheral surfaces of the first sleeve member and the second sleeve member after having been applied to the peripheral surface of the photosensitive material drum in the developing zone should be once peeled off from the peripheral surfaces of the first sleeve member and of the second sleeve member, and is again stirred and conveyed by the action of the developing agent stirring/conveying mechanism. That is, the developing agent peeled off from the peripheral surfaces of the two sleeve members contains the toner at a decreased concentration since the toner has been consumed by the action of developing.

Therefore, if the developing agent is directly conveyed again to the developing zone and is repetitively applied to the peripheral surface of the photosensitive material drum, it becomes difficult to execute favorable developing as desired. As for the first sleeve member constituting the first developing agent application means, the developing agent stirred and conveyed by the developing agent stirring/conveying mechanism acts on the peripheral surface of the first sleeve member on the downstream side of the developing zone as viewed in a direction in which the first sleeve member rotates, whereby the developing agent that has been adsorbed to, and held by, the peripheral surface of the first sleeve member is peeled off, and is mixed to the developing agent that is being stirred and conveyed. As for the second sleeve member constituting the second developing agent application means which is disposed on the upper side of the first developing agent application means, however, the developing agent stirred and conveyed by the developing agent stirring/conveying mechanism does not act on the peripheral surface of the second sleeve member. In the conventional apparatus for developing electrostatic latent images, therefore, the second developing agent application means is so constituted on the downstream side of the developing zone as viewed in a direction in which the second sleeve member rotates as to form a developing agent-peeling zone in which the magnetic attraction force for adsorbing the developing agent on the peripheral surface of the second sleeve member extinguishes or drastically decreases, a developing agent return guide plate is disposed facing to the peripheral surface of the second sleeve member, the developing agent on the peripheral surface of the second sleeve member is peeled off by the developing agent return guide plate, and the developing agent peeled off is conveyed into the developing agent stirring/conveying mechanism. In order that the developing agent is smoothly conveyed and guided by the developing agent return guide plate, the angle of inclination of the developing agent return guide plate must be increased. For this purpose, there has been proposed an apparatus in which a magnetic conveyer means constituted by a sleeve member that is rotated in the same direction as the second sleeve member and a magnet means disposed in the sleeve member, is disposed between the second developing agent application means and the developing agent return guide plate, and the developing agent conveyed by the second sleeve member is magnetically adsorbed to, and held by, the peripheral surface of the sleeve member in the magnetic conveyer means and is conveyed onto the developing agent return guide plate.

It is desired that the developing agent magnetically adsorbed and conveyed by the peripheral surface of the second sleeve member that constitutes the second developing agent application means, is all transferred onto the sleeve member of the magnetic conveyer means. If the developing agent is not transferred onto the sleeve member of the magnetic conveyer means but passes between the two in a state of being magnetically adsorbed to the peripheral surface of the second sleeve member, then, the developing agent is supplied again to the developing or falls down due to gravity. If the developing agent is fed again to the developing in a state of being magnetically adsorbed to the peripheral surface of the second sleeve member, the developing agent is fed in an increased amount to the developing, whereby the image density becomes irregular. Besides, since the developing agent passes in an increased amount between the first sleeve member constituting the first developing agent application means and the second sleeve member constituting the second developing agent application means, an increased torque is required for driving the two sleeves, and the developing agent is vigorously rubbed together to undergo deterioration.

Further, the magnetic conveyer means is provided with the developing agent-peeling zone at a position facing to the developing agent return guide plate. Even in the developing agent-peeling zone, however, it is difficult to completely extinguish the magnetic force; i.e., magnetic force necessarily exists. Accordingly, this makes it difficult to set magnetic poles at a position facing to the developing agent return guide plate of the magnet means that constitutes the magnetic conveyer means. Besides, when a gap is great between the developing agent return guide plate and the peripheral surface of the sleeve member of the magnetic conveyer means, the developing agent partly passes through the gap relative to the developing agent return guide plate and falls down. Therefore, when it is attempted to reliably peel off the developing agent that has been magnetically adsorbed to, and held by, the peripheral surface of the sleeve member of the magnetic conveyer means and conveyed to the developing agent-peeling zone, then, the developing agent return guide plate must be brought into contact with the peripheral surface of the sleeve member of the magnetic conveyer means. This causes problems that an increased force is required for driving the sleeve member of the magnetic conveyer means and the developing agent is easily deteriorated. Besides, a problem arises in regard to the durability of the developing agent return guide plate and the sleeve member.

Further, to meet an increase in the speed for forming image, Japanese Unexamined Patent Publication (Kokai) No. 17829/1977 discloses an apparatus for developing an electrostatic latent image, which is equipped with three developing agent application means for reliably applying the developing agent onto the peripheral surface of the photosensitive material drum. According to the apparatus for developing an electrostatic latent images disclosed in this publication, provision is made of three developing agent application means arranged facing to the peripheral surface of the photosensitive material drum in the developing zone, and a developing agent comprising carrier particles and a toner is applied onto the peripheral surface of the photosensitive material drum by the three developing agent application means to develop the electrostatic latent image into a toner image.

More detailedly, the three developing agent application means in the apparatus for developing electrostatic latent images are each constituted by a sleeve member that is driven to rotate and a magnet means disposed in the sleeve member. The sleeve members constituting the three developing agent application means are so rotated that their peripheral surfaces move in the forward direction relative to the motion of the peripheral surface of the photosensitive material drum in the developing zone. The apparatus for developing electrostatic latent image is equipped with a developing agent stirrer member. The developing agent stirred and conveyed by the developing agent stirrer member is magnetically adsorbed to, and held by, the peripheral surface of the sleeve member that constitutes the developing agent application means arranged on the most downstream side among the three developing agent application means, and is conveyed toward a portion facing to the developing agent application means disposed at an intermediate position. The developing agent thus magnetically adsorbed to, and held by, the peripheral surface of the sleeve member of the developing agent application means disposed on the most downstream side and conveyed toward the portion facing to the developing agent application means disposed at an intermediate position, is then magnetically adsorbed to, and transferred onto, the peripheral surface of the sleeve member constituting the developing agent application means disposed at an intermediate position and is conveyed toward a portion facing to the developing agent application means disposed on the most upstream side. The developing agent thus magnetically adsorbed to, and held by, the peripheral surface of the sleeve member of the developing agent application means disposed at the intermediate position and conveyed toward the portion facing to the developing agent application means disposed on the most upstream side, is then magnetically adsorbed to, and transferred onto, the peripheral surface of the sleeve member constituting the developing agent application means disposed on the most upstream side, and is conveyed toward the developing zone. The developing agent thus magnetically adsorbed to, and held by, the peripheral surface of the sleeve member of the developing agent application means disposed on the most upstream side, is then applied onto the peripheral surface of the photosensitive material drum in the developing zone.

The developing agent thus magnetically adsorbed to, and held by, the peripheral surface of the sleeve member of the developing agent application means disposed on the most upstream side and has passed through the developing zone, is then magnetically adsorbed toe, and transferred onto, the peripheral surface of the sleeve member of the developing agent application means disposed at an intermediate position and is conveyed to the developing zone, and is applied onto the peripheral surface of the photosensitive material drum. The developing agent thus magnetically adsorbed to, and held by, the peripheral surface of the sleeve member of the developing agent application means disposed at an intermediate position and has passed through the developing zone, is then magnetically adsorbed to, and transferred onto, the peripheral surface of the sleeve member of the developing agent application means disposed on the most downstream side, and is conveyed to the developing zone and is applied onto the peripheral surface of the photosensitive material drum. The developing agent thus magnetically adsorbed to, and held by, the peripheral surface of the sleeve member of the developing agent application means disposed on the most downstream side, and has passed through the developing zone, is then peeled off from the peripheral surface of the sleeve member and is mixed into the developing agent in the developing housing.

In the above-mentioned apparatus for developing electrostatic latent image, the developing agent scooped by the developing agent application means disposed on the most downstream side is conveyed successively upwardly by the back surfaces of the developing agent application means disposed at the intermediate position and of the developing agent application means disposed on the most upstream side. Then, the developing agent conveyed by the developing agent application means disposed on the most upstream side is conveyed to the developing zone facing to the peripheral surface of the photosensitive material drum, and is further conveyed successively downwardly through the developing agent application means disposed at the intermediate position and the developing agent application means disposed on the most downstream side. Thus, in the above-mentioned apparatus for developing electrostatic latent image, the developing agent scooped by the developing agent application means disposed on the most downstream side is all conveyed successively up to the developing agent application means disposed on the most upstream side, and is then conveyed successively up to the developing agent application means disposed on the most downstream side. Therefore, this involves a problem in that the developing agent is conveyed very inefficiently.

SUMMARY OF THE INVENTION

The first object of the present invention is to provide an apparatus for developing an electrostatic latent image, in which a predetermined relationship is set between a second magnet means constituting the second developing agent application means and magnetic poles formed in the magnet means constituting the magnetic conveyer means, so that the developing agent magnetically adsorbed to, and conveyed by, the peripheral surface of the second sleeve member constituting the second developing agent application means can be reliably transferred onto the sleeve member of the magnetic conveyer means.

The second object of the present invention is to provide an apparatus for developing an electrostatic latent image, in which a gap is set to a suitable value between the peripheral surface of the sleeve member of the magnetic conveyer means and the developing agent return guide plate, so that the developing agent on the peripheral surface of the sleeve member of the magnetic conveyer means can be reliably peeled off without requiring an increased driving force.

The third object of the present invention is to provide an apparatus for developing an electrostatic latent image, which enables the developing agent conveyed magnetically adsorbed to, and held by, the peripheral surface of the sleeve member constituting the magnetic conveyer means, to be sent to the developing agent return guide plate without causing the developing agent to be deteriorated and without requiring an increased torque for driving the sleeve member.

The fourth object of the present invention is to provide an apparatus for developing an electrostatic latent image, which is equipped with three developing agent application means and conveys the developing agent favorably.

In order to accomplish the above-mentioned first object, the present invention provides an apparatus for developing an electrostatic latent image formed on the peripheral surface of a photosensitive material drum that moves passing through a developing zone into a toner image by applying a developing agent comprising carrier particles and a toner onto the peripheral surface of said photosensitive material drum in said developing zone, said apparatus for developing the electrostatic latent image comprising:

a developing housing;

a first developing agent application means constituted by a first sleeve member that is arranged in parallel with said photosensitive material drum at the front end in said developing housing and is rotated so as to move in the forward direction relative to the direction in which the peripheral surface of said photosensitive material drum moves in said developing zone, and a first magnet means disposed in said first sleeve member;

a second developing agent application means constituted by a second sleeve member that is arranged in parallel with said photosensitive material drum on the upstream side in a direction in which the peripheral surface of said photosensitive material drum moves relative to said first developing agent application means and is rotated so as to move in a direction opposite to the direction in which the peripheral surface of said photosensitive material drum moves in said developing zone, and a second magnet means disposed in said second sleeve member;

a developing agent stirring/conveying mechanism that is disposed at the back of said first developing agent application means and conveys, while stirring, the developing agent to said first developing agent application means;

a magnetic conveyer means constituted by a sleeve member that is disposed at the back of said second developing agent application means and is rotated in the same direction as said second sleeve member, and a magnet means disposed in said sleeve member; and a developing agent return guide plate that is disposed at the back of said magnetic conveyer means and sends the developing agent conveyed by said magnetic conveyer means, toward the side of said developing agent stirring/conveying mechanism;

wherein said second magnet means constituting said second developing agent application means includes a developing agent-peeling zone having magnetic poles of the same polarity neighboring each other on the upstream side of a position where said second sleeve member and the sleeve member of said magnetic conveyer means are nearest to each other, in the direction in which said second sleeve member rotates; and said magnet means constituting said magnetic conveyer means has a magnetic pole at a position facing to said developing agent-peeling zone formed in said second magnet means, the magnetic pole having a polarity opposite to that of the magnetic poles forming said developing agent-peeling zone.

In order to accomplish the above-mentioned second object, the present invention provides an apparatus for developing an electrostatic latent image formed on the peripheral surface of a photosensitive material drum that moves passing through a developing zone into a toner image by applying a developing agent comprising carrier particles and a toner onto the peripheral surface of said photosensitive material drum in said developing zone, said apparatus for developing the electrostatic latent image comprising:

a developing housing;

a first developing agent application means constituted by a first sleeve member that is arranged in parallel with said photosensitive material drum at the front end in said developing housing and is rotated so as to move in the forward direction relative to the direction in which the peripheral surface of said photosensitive material drum moves in said developing zone, and a first magnet means disposed in said first sleeve member;

a second developing agent application means constituted by a second sleeve member that is arranged in parallel with said photosensitive material drum on the upstream side in a direction in which the peripheral surface of said photosensitive material drum moves relative to said first developing agent application means and is rotated so as to move in a direction opposite to the direction in which the peripheral surface of said photosensitive material drum moves in said developing zone, and a second magnet means disposed in said second sleeve member; and a developing agent stirring/conveying mechanism for conveying, while stirring, the developing agent to said first developing agent application means, the developing agent stirred and conveyed by said developing agent stirring/conveying mechanism being magnetically adsorbed to, and held by, the peripheral surface of said first sleeve member, and part of the developing agent adsorbed to, and held by, the peripheral surface of said first sleeve member being transferred onto the peripheral surface of said second sleeve member and being magnetically adsorbed thereto, and held thereby, so as to be applied onto the peripheral surface of said photosensitive material drum in said developing zone, and the developing agent that has not been transferred onto the peripheral surface of said second developing sleeve member but has been maintained adsorbed to, and held by, the peripheral surface of said first sleeve member, being applied to the peripheral surface of said photosensitive material drum in said developing zone; wherein at the back of said second developing agent application means is disposed a magnetic conveyer means constituted by a sleeve member that rotates in the same direction as said sleeve member and a magnet means disposed in said sleeve member, at the back of said magnetic conveyer means is disposed a developing agent return guide plate that feeds the developing agent conveyed by being magnetically adsorbed to, and held by, the peripheral surface of said sleeve member to the side of said developing agent stirring/conveying mechanism, and a gap between the front end of said developing agent return guide plate and the peripheral surface of said sleeve member is set to be 10 to 30 times as great as the diameter of the carrier particles.

In order to accomplish the above-mentioned third object, the present invention provides an apparatus for developing an electrostatic latent image formed on the peripheral surface of a photosensitive material drum that moves passing through a developing zone into a toner image by applying a developing agent comprising carrier particles and a toner onto the peripheral surface of said photosensitive material drum in said developing zone, said apparatus for developing the electrostatic latent image comprising:

a developing housing;

a first developing agent application means constituted by a first sleeve member that is arranged in parallel with said photosensitive material drum at the front end in said developing housing and is rotated so as to move in the forward direction relative to the direction in which the peripheral surface of said photosensitive material drum moves in said developing zone, and a first magnet means disposed in said first sleeve member;

a second developing agent application means constituted by a second sleeve member that is arranged in parallel with said photosensitive material drum on the upstream side in a direction in which the peripheral surface of said photosensitive material drum moves relative to said first developing agent application means and is rotated so as to move in a direction opposite to the direction in which the peripheral surface of said photosensitive material drum moves in said developing zone, and a second magnet means disposed in said second sleeve member;

a developing agent stirring/conveying mechanism that is disposed at the back of said first developing agent application means and conveys, while stirring, the developing agent to said first developing agent application means;

an ear-cutting plate disposed along said first developing agent application means, acts on the developing agent that moves being magnetically held by the peripheral surface of said first sleeve member to properly limit the thickness of the layer of the developing agent held on the peripheral surface of said first sleeve member;

a magnetic conveyer means constituted by a sleeve member that is disposed at the back of said second developing agent application means and is rotated in the same direction as said second sleeve member and a magnet means disposed in said sleeve member; and a developing agent return guide plate that is disposed on the lower side of said magnetic conveyer means and sends the developing agent conveyed by said magnetic conveyer means toward the side of said developing agent stirring/conveying mechanism.

In order to accomplish the above-mentioned fourth object, the present invention provides an apparatus for developing an electrostatic latent image formed on the peripheral surface of a photosensitive material drum that moves passing through a developing zone into a toner image by applying a developing agent comprising carrier particles and a toner onto the peripheral surface of said photosensitive material drum in said developing zone, said apparatus for developing the electrostatic latent image comprising:

a developing housing;

a first developing agent application means constituted by a first sleeve member that is arranged in parallel with said photosensitive material drum in said developing housing and is rotated so as to move in the forward direction relative to the direction in which the peripheral surface of said photosensitive material drum moves in said developing zone, and a first magnet means disposed in said first sleeve member;

a second developing agent application means constituted by a second sleeve member that is arranged in parallel with said photosensitive material drum on the upstream side in a direction in which the peripheral surface of said photosensitive material drum moves relative to said first developing agent application means and is rotated so as to move in a direction opposite to the direction in which the peripheral surface of said photosensitive material drum moves in said developing zone, and a second magnet means disposed in said second sleeve member;

a third developing agent application means constituted by a third sleeve member that is arranged in parallel with said photosensitive material drum on the downstream side in a direction in which the peripheral surface of said photosensitive material drum moves relative to said first developing agent application means and is rotated so as to move in the forward direction relative to the direction in which the peripheral surface of said photosensitive material drum moves in said developing zone, and a third magnet means disposed in said third sleeve member; and a developing agent stirring/conveying mechanism for conveying, while stirring, the developing agent to said first developing agent application means; wherein the magnetic poles of said first magnet means, said second magnet means and said third magnet means are so set that the developing agent stirred and conveyed by said developing agent stirring/conveying mechanism is magnetically adsorbed to, and held by, the peripheral surface of said first sleeve member, that part of the developing agent adsorbed to, and held by, the peripheral surface of said first sleeve member is transferred onto the peripheral surface of said second sleeve member and is magnetically adsorbed thereto, and held thereby, and is applied to the peripheral surface of said photosensitive material drum in said developing zone, and that the developing agent that has not been transferred onto the peripheral surface of said second member but has been maintained adsorbed to, and held by, the peripheral surface of said first sleeve member, is applied onto the peripheral surface of said photosensitive material drum in said developing zone and is, then, adsorbed to, and held by, the peripheral surface of said third sleeve member, and is applied to the peripheral surface of said photosensitive material drum in said developing zone.

It is desired that a gap (G1) at a position where the first sleeve member and the second sleeve member are nearest to each other, is set to a value which permits about one-half of the developing agent magnetically adsorbed to, and held by, the peripheral surface of the first sleeve member to be transferred onto the peripheral surface of the second sleeve member, and is set to be from 2.0 to 4.0 mm. It is further desired that a gap (G2) at a position where the first sleeve member and the third sleeve member are nearest to each other, is set to be from one-third to one-half of the gap (G1). It is desired that the third magnet means constituting the third developing agent application means is not magnetized in a region on the side of the developing agent stirring/conveying mechanism beyond a line connecting the center thereof with the center of the first magnet means that constitutes the first developing agent application means.

The developing agent stirring/conveying mechanism is disposed at the back of said first developing agent application means and comprises a magnetic conveyer means constituted by a sleeve member that is disposed at the back of said second developing agent application means and is rotated in the same direction as said second sleeve and a magnet means disposed in said sleeve member, and a developing agent return guide plate that is disposed at the back of said magnetic conveyer means and sends the developing agent conveyed by said magnetic conveyer means to the side of said developing agent stirring/conveying mechanism; and the magnet means of said magnetic conveyer means has magnetic poles which are so set that the developing agent conveyed by being magnetically adsorbed to, and held by, the peripheral surface of the second sleeve member, is transferred onto the peripheral surface of said sleeve member and is conveyed by being magnetically adsorbed thereto, and held thereby, and is peeled off from the peripheral surface of said sleeve member at a position facing to the developing agent return guide plate.

DETAILED DESCRIPTION OF THE PREFERRED EMBODIMENTS

Preferred embodiments of the apparatus for developing electrostatic latent image constituted according to the present invention will now be described in further detail with reference to the accompanying drawings.

Figure 1:
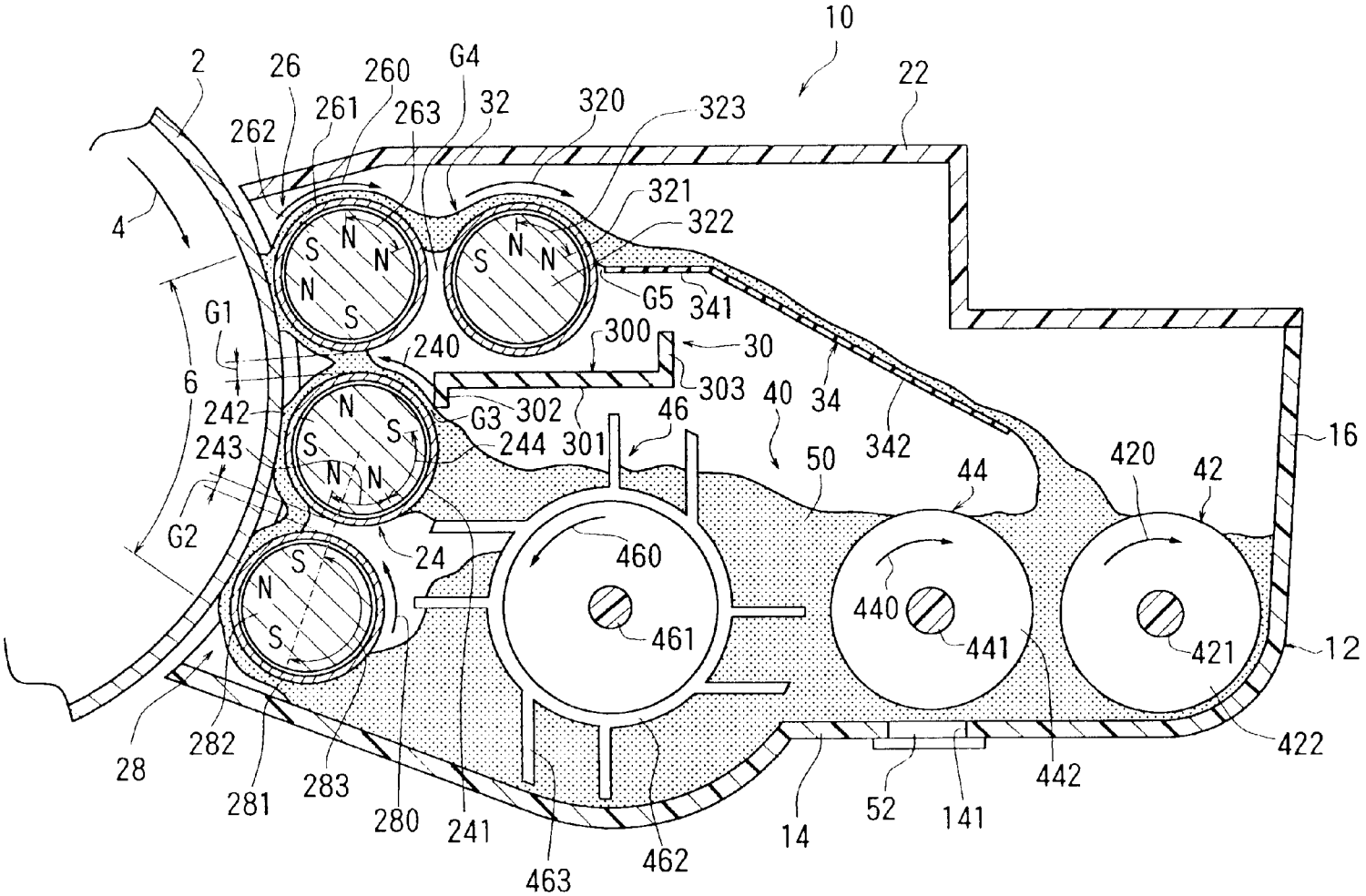
FIG. 1 is a sectional view showing an apparatus for developing an electrostatic latent image constituted according to an embodiment of the present invention.

FIG. 1 illustrates an embodiment of the apparatus for developing electrostatic latent image constituted according to the present invention together with part of a photosensitive material drum 2 that constitutes an image carrier. The photosensitive material drum 2 has a suitable electrostatic photosensitive material arranged on the peripheral surface thereof, and is rotated in a direction indicated by an arrow 4 in the drawing by a suitable drive means that is not shown so as to pass via a developing zone 6. The developing zone 6 extends up and down in a direction in which the peripheral surface of the photosensitive material drum 2 moves. Therefore, the peripheral surface of the photosensitive material drum 2 moves from the upper side toward the lower side in the developing zone 6 as it is rotated in a direction indicated by the arrow 4 in the drawing. On the upstream side of the developing zone 6, an electrostatic latent image is formed on the peripheral surface of the photosensitive material drum 2 by a known suitable electrostatic latent image-forming means. In the developing zone 6, the electrostatic latent image formed on the peripheral surface of the photosensitive material drum 2 is developed into a toner image by the apparatus for developing electrostatic latent image constituted according to the present invention as generally designated at 10. The thus developed toner image is transferred onto a transfer member such as common paper by a transfer means that is not shown, on the downstream side of the developing zone 6. The toner image transferred onto the transfer member is thermally fixed by a fixing means that is not shown, thereby to obtain a copy or a printed matter.

Next, the apparatus 10 for developing electrostatic latent image will be described with reference to FIGS. 1 and 2. The apparatus 10 for developing electrostatic latent image is equipped with a developing housing 12. The developing housing 12 which can be made of a suitable plastic material includes a bottom wall 14, a rear wall 16 that upwardly extends substantially vertically from the rear edge of the bottom wall 14, a front end wall 18 and a rear end wall 20. A cover member 22 made of a suitable plastic material is arranged on the thus constituted developing housing 12 to cover the upper surface thereof.

At the forefront part of the developing housing 12 (the leftmost part in FIG. 1, or the top part in FIG. 2), there are arranged a first developing agent application means 24 disposed in the developing zone 6, a second developing agent application means 26 disposed on the upper side of the first developing agent application means 24, i.e., disposed on the upstream side in a direction in which the photosensitive material drum 2 moves in the developing zone 6, and a third developing agent application means 28 disposed on the lower side of the first developing agent application means 24, i.e., disposed on the downstream side in a direction in which the photosensitive material drum 2 moves in the developing zone 6.

The first developing agent application means 24 is constituted by a first sleeve member 241 arranged in parallel with the photosensitive material drum 2 and extends in a direction of width thereof which is substantially horizontal in the developing zone 6 (in a direction perpendicular to the surface of the paper in FIG. 1, or in the right-and-left direction in FIG. 2), and a first magnet means 242 disposed in the first sleeve member 241. The first sleeve member 241 is made of a nonmagnetic material such as aluminum, and is rotatably mounted to the developing housing 12. The first magnet means 242 is constituted by stationary permanent magnets having a circular shape in cross section, and is secured at a predetermined position in the first sleeve member 241. N-poles and S-poles are formed as shown in FIG. 1 on the outer peripheral surface of the stationary permanent magnets as the first magnet means 242. That is, on the outer peripheral surface of the stationary permanent magnets, there are magnetized an N-pole and another N-pole neighboring each other at positions facing to the third developing agent application means 28. In a portion between these neighboring N-poles, there is defined a developing agent-peeling zone 243 where there does not substantially exist, or slightly exists, the magnetic attraction force for adsorbing the developing agent onto the surface of the first sleeve ember 241. On the outer peripheral surface of the stationary permanent magnets, furthermore, an N-pole is magnetized at a position facing to the second developing agent application means 26, and S-poles are magnetized between the above-mentioned N-pole and the developing agent-peeling zone 243. Referring to FIG. 2, a rotary shaft 245 to which the first sleeve member 241 is secured is protruded rearward penetrating through the rear end wall 20 of the developing housing 12. An input gear (not shown) is secured to a protruded end of the rotary shaft 245, and is drivingly coupled to a rotary drive source (not shown) which may be an electric motor, via a suitable transmission gear (not shown). The first sleeve member 241 of the thus constituted first developing agent application means 24 is allowed to rotate so as to move in a direction indicated by an arrow 240 in FIG. 1, i.e., so as to move in the forward direction relative to the motion of the photosensitive material drum 2 in the developing zone 6.

The second developing agent application means 26 is disposed on the upstream side (on the upper side of the first developing agent application means 24 in FIG. 1) in the direction in which the photosensitive material drum 2 moves relative to the first developing agent application means 24 in the developing zone 6. Like the first developing agent application means 24, the second developing agent application means 26 is constituted by a second sleeve member 261 arranged in parallel with the photosensitive drum 2 and extends in a direction of width thereof which is substantially horizontal (in a direction perpendicular to the surface of the paper in FIG. 1, or in the right-and-left direction in FIG. 2), and a second magnet means 262 disposed in the second sleeve member 261. The second sleeve member 261 is made of a nonmagnetic material such as aluminum, and is rotatably mounted to the developing housing 12. The second magnet means 262 is constituted by stationary permanent magnets having a circular shape in cross section, and is secured at a predetermined position in the second sleeve member 261. N-poles and S-poles are formed as shown in FIG. 1 on the outer peripheral surface of the stationary permanent magnets as the second magnet means 262. That is, on the outer peripheral surface of the stationary permanent magnets, there is magnetized an S-pole at a position facing to the first developing agent application means 24, the S-pole having a polarity that is opposite to the N-pole magnetized in the first magnet means 242. Referring to FIG. 1, an N-pole and another N-pole are magnetized at right upper portions neighboring each other. In a portion between these neighboring N-poles, there is defined a developing agent-peeling zone 263 where there does not substantially exist, or slightly exists, the magnetic attraction force for adsorbing the developing agent onto the surface of the second sleeve member 261. As shown in FIG. 3, it is important that the developing agent-peeling zone 263 is formed on the upstream side of a position P where the second sleeve member 261 constituting the second developing agent application means 26 and a sleeve member 321 of a magnetic conveyer means 32 that will be described later are nearest to each other, in the direction in which the second sleeve member 261 rotates. On the outer peripheral surface of the stationary permanent magnets, furthermore, an N-pole and an S-pole are magnetized between the S-pole at the position facing to the first developing agent application means 24 and the N-pole of the side of the developing zone 6 forming the developing agent-peeling zone 263. Referring to FIG. 2, a rotary shaft 265 to which the second sleeve member 261 is secured is protruded rearward penetrating through the rear end wall 20 of the developing housing 12. An input gear (not shown) is secured to a protruded end of the rotary shaft 265, and is coupled to the input gear (not shown) secured to the rotary shaft 245 of the first developing agent application means 24. The second sleeve member 261 of the thus constituted second developing agent application means 26 is rotated in a direction indicated by an arrow 260 in FIG. 1, i.e., rotated so as to move in a direction opposite to the motion of the photosensitive material drum 2 in the developing zone 6.

The third developing agent application means 28 is disposed on the downstream side (on the lower side of the first developing agent application means 24 in FIG. 1) in the direction in which the photosensitive material drum 2 moves relative to the first developing agent application means 24 in the developing zone 6. Like the first developing agent application means 24 and the second developing agent application means 26, the third developing agent application means 28 is constituted by a third sleeve member 281 arranged in parallel with the photosensitive material drum 2 and extends in a direction of width thereof which is substantially horizontal (in a direction perpendicular to the surface of the paper in FIG. 1, or in the right-and-left direction in FIG. 2), and a third magnet means 282 disposed in the third sleeve member 281. The third sleeve member 281 is made of a nonmagnetic material such as aluminum, and is rotatably mounted to the developing housing 12. The third magnet means 282 is constituted by stationary permanent magnets having a circular shape in cross section, and is secured at a predetermined position in the third sleeve member 281. N-poles and S-poles are formed as shown in FIG. 1 on the outer peripheral surface of the stationary permanent magnets as the third magnet means 282. In the illustrated embodiment, the stationary permanent magnets are magnetized in the left half portion but are not magnetized in the right half portion. In the left half of the stationary permanent magnets, i.e., on the side of the developing zone 6 beyond a line connecting the center of the third magnet means 282 with the center of the first magnet means 242 constituting the first developing agent application means 24, there are magnetized an S-pole at a position facing to the first developing agent application means 24, the S-pole having a polarity that is opposite to the N-pole magnetized in the first magnet means 242, an N-pole neighboring the above-mentioned S-pole, and another S-pole neighboring the above N-pole. On the other hand, a developing agent-peeling zone 283 that is not magnetized is defined in the right half of the stationary permanent magnets, i.e., in the region of the side of the developing agent stirring/conveying mechanism 40 that will be described later beyond the line connecting the center of the third magnet means 282 with the center of the first magnet means 242 constituting the first developing agent application means 24. Referring to FIG. 2, a rotary shaft 285 to which the third sleeve member 281 is secured is protruded rearward penetrating through the rear end wall 20 of the developing housing 12. An input gear (not shown) is secured to a protruded end of the rotary shaft 285, and is coupled to the input gear (not shown) secured to the rotary shaft 245 of the first developing agent application means 24. The third sleeve member 281 of the thus constituted third developing agent application means 28 is rotated in a direction indicated by an arrow 280 in FIG. 1, i.e., rotated so as to move in the forward direction relative to the motion of the photosensitive material drum 2 in the developing zone 6.

The thus constituted first developing agent application means 24, the second developing agent application means 26 and the third developing agent application means 28 are disposed, at their vis-a-vis positions, spaced at predetermined gaps. It is desired that a gap (G1) at a position where the first sleeve member 241 constituting the first developing agent application means 24 and the second sleeve member 261 constituting the second developing agent application means 26 are nearest to each other, is set to a value that permits about one-half of the developing agent magnetically adsorbed to, and held by, the peripheral surface of the first sleeve member 241 to be transferred onto the peripheral surface of the second sleeve member 261, and is set to be from 2.0 to 4.0 mm in the illustrated embodiment. When the gap (G1) is larger than 4.0 mm, the developing agent 25 is transferred in a decreased amount from the first sleeve member 241 to the second sleeve member 261, while when the gap (G1) is smaller than 2.0 mm, the developing agent is transferred in an increased amount from the first sleeve member 241 to the second sleeve member 261. In either case, balance is lost between the conveyed amount of the developing agent by the first sleeve member 241 and that by the second sleeve 261. It is further desired that a gap (G2) at a position where the first sleeve member 241 constituting the first developing agent application means 24 and the third sleeve member 281 constituting the third developing agent application means 28 are nearest to each other, is set to a value which permits the developing agent magnetically adsorbed to, and held by, the peripheral surface of the first sleeve member 241 to be all transferred onto the peripheral surface of the third sleeve member 281, and is set to be from one-third to one-half of the above-mentioned gap (G1) and is set, in the illustrated embodiment, to be from 0.67 to 2.0 mm. When the gap (G2) is larger than one-half of the above-mentioned gap (G1), the developing agent magnetically adsorbed to, and held by, the peripheral surface of the first sleeve member 241 is not all transferred onto the third sleeve member 281 and consequently, the density of the image becomes irregular due to the lack of the developing agent. On the other hand, when the gap (G2) becomes smaller than one-third of the above-mentioned gap (G1), an increased torque is required for driving the first sleeve member 241 and the third sleeve member 281, whereby the developing agent receives much stress and deteriorates early.

With further reference to FIG. 1, the apparatus 10 for developing an electrostatic latent image is further provided with an ear-cutting means 30. In the illustrated embodiment, the ear-cutting means 30 is constituted by an ear-cutting plate 300 that extends in the direction of width thereof (in a direction perpendicular to the surface of the paper in FIG. 1, or in the right-and-left direction in FIG. 2) along the first developing agent application means 24. In the illustrated embodiment, the ear-cutting plate 300 is made of an aluminum alloy, and comprises a horizontal portion 301, an ear-cutting portion 302 downwardly bent nearly at a right angle at an end on the side of the first developing agent application means 24 (left side in FIG. 1), and a weir portion 303 upwardly bent nearly at a right angle at an end on the right side of the horizontal portion 301 in FIG. 1. The front edge of the ear-cutting portion 302 constituting the ear-cutting plate 300 is disposed at a position close to the peripheral surface of the first sleeve member 241, on the upstream side of the developing zone 6 and on the upstream side of a position where the first sleeve member 241 and the second sleeve member 261 face each other as viewed in the direction (indicated by an arrow 240) in which the first sleeve member 241 constituting the first developing agent application means 24 rotates. A gap (G3) between the front edge of the ear-cutting portion 302 constituting the ear-cutting plate 300 and the peripheral surface of the first sleeve member 241 is set to be from about 0.5 to about 1.0 mm in the illustrated embodiment.

A magnetic conveyer means 32 is disposed at the back (on the right side in FIG. 1) of the second developing agent application means 26. The magnetic conveyer means 32 is constituted by a sleeve member 321 that is disposed in parallel with the second developing agent application means 26 and extends in the direction of width thereof (in a direction perpendicular to the surface of the paper in FIG. 1, or in the right-and-left direction in FIG. 2) which is substantially horizontal, and a magnet means 322 disposed in the sleeve member 321. The sleeve member 321 is made of a nonmagnetic material such as aluminum, and is rotatably mounted on the developing housing 12.

The magnet means 322 is constituted by stationary permanent magnets having a circular shape in cross section, and is secured at a predetermined position in the sleeve member 321. N-poles and S-poles are formed as shown in FIG. 1 on the outer peripheral surface of the stationary permanent magnets as the magnet means 322. That is, the outer peripheral surface of the stationary permanent magnets is magnetized in nearly the one-half region on the upper side thereof, and, as shown in FIG. 3, an S-pole is magnetized at a position facing to the developing agent-peeling zone 263 of the second magnet means 262 that constitutes the second developing agent application means 26, the S-pole having a polarity opposite to that of the N-poles forming the developing agent-peeling zone 263. On the outer peripheral surface of the stationary permanent magnets, there are magnetized an N-pole and another N-pole neighboring each other on the upper side and on the right side in FIG. 1. In a portion between these neighboring N-poles, there is defined a developing agent-peeling zone 323 where there does not substantially exist, or slightly exists, the magnetic attraction force for adsorbing the developing agent onto the surface of the sleeve member 321. A gap (G4) at a position where the sleeve member 321 constituting the magnetic conveyer means 32 and the second sleeve member 261 constituting the second developing agent application means 26 are nearest to each other, is set to be from 0.67 to 2.0 mm in the illustrated embodiment. As shown in FIG. 2, the rotary shaft 325 to which the sleeve member 321 is secured is protruded rearward penetrating through the rear end wall 20 of the developing housing 12. An input gear (not shown) is secured to the protruded end of the rotary shaft 325, and is coupled to the input gear (not shown) secured to the rotary shaft 265 of the second developing agent application means 26. The sleeve member 321 of the thus constituted magnetic conveyer means 32 is rotated in a direction indicated by an arrow 320 in FIG. 1.

Figure 4:
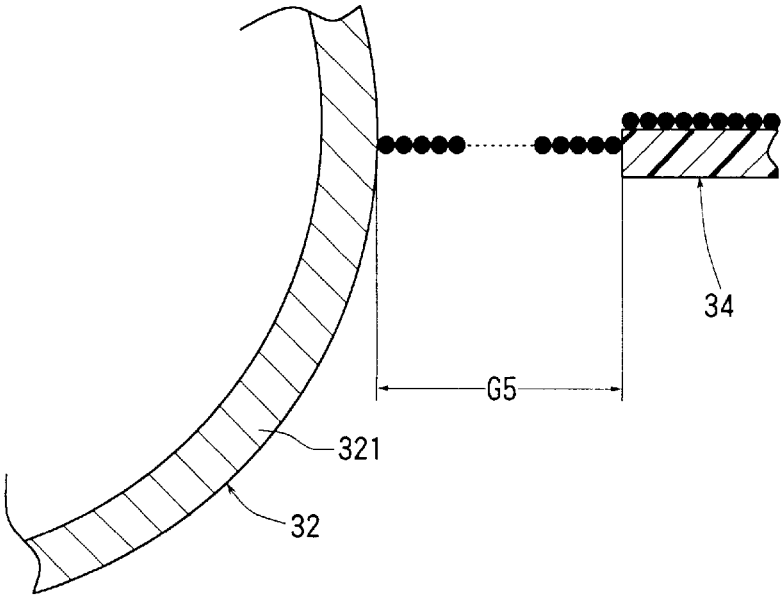
FIG. 4 is a view illustrating a state where the developing agent is peeled off in the case when a gap is great between a second sleeve member constituting the second developing agent application means and a developing agent return guide plate in the apparatus for developing an electrostatic latent image shown in FIG. 1.

At the back (right side in FIG. 1) of the magnetic conveyer means 32, the developing agent return guide plate 34 extends in the direction of width (in a direction perpendicular to the surface of the paper in FIG. 1, or the right-and-left direction in FIG. 2) along the magnetic conveyer means 32. The developing agent return guide plate 34 is made of a nonmagnetic stainless steel, and comprises a horizontal portion 341 having a front edge disposed facing to the lower part of the developing agent-peeling zone 323 of the magnetic conveyer means 32 and an inclined portion 342 that is inclined downward from the rear end (right end in FIG. 1) of the horizontal portion 341. As shown in FIG.4, a gap (G5) between the front edge of the horizontal portion 341 constituting the developing agent return guide plate 34 and the peripheral surface of the sleeve member 321 constituting the magnetic conveyer means 32, is set to be from 10 to 30 times as great as the diameter of the carrier particles of the developing agent used.

In the illustrated embodiment, the gap (G5) is set to be from 0.5 to 3.0 mm. The lower end of the inclined portion 342 constituting the developing agent return guide plate 34 is located on the upper side of the upstream side of a developing agent stirring/conveying mechanism 40 that will be described below.

The developing agent stirring/conveying mechanism 40 will now be described with reference to FIGS. 1 and 2.

The developing agent stirring/conveying mechanism 40 is disposed at the back of the first developing agent application means 24 and the third developing agent application means 28. The developing agent stirring/conveying mechanism 40 in the illustrated embodiment includes a first stirring/conveying means 42, a second stirring/conveying means 44 and a third stirring/conveying means 46 that are arranged in parallel with each other and extend in the direction of width thereof (in a direction perpendicular to the surface of the paper in FIG. 1, or in the right-and-left direction in FIG. 2).

The first stirring/conveying means 42 is disposed at a position remotest from the first developing agent application means 24 and from the third developing agent application means 28, i.e., disposed at a position on the most upstream side. Referring to FIG. 2, the first stirring/conveying means 42 comprises a rotary shaft 421 rotatably mounted between both end walls 18 and 20 of the developing housing 12, and a spiral vane 422 formed in the axial direction of the rotary shaft 421, i.e., in the direction of width thereof. They are made of a suitable plastic material as a unitary structure. The rotary shaft 421 constituting the first stirring/conveying means 42 is protruded rearward penetrating through the rear end wall 20 of the developing housing 12. An input gear (not shown) is secured to the protruded end of the rotary shaft 421 and is coupled to a drive mechanism (not shown) that drives the above-mentioned developing agent application means. The thus constituted first stirring/conveying means 42 is rotated in a direction indicated by an arrow 420 in FIG. 1, and conveys the developing agent from the front side toward the back side as indicated by an arrow in FIG. 2 while stirring the developing agent near the portion of the rear wall 16 of the developing housing 12.

The second stirring/conveying means 44 is disposed on the front side of the first stirring/conveying means 42, i.e., disposed between the first stirring/conveying means and the third stirring/conveying means 46. Like the first stirring/conveying means 42, the second stirring/conveying means 44 comprises a rotary shaft 441 rotatably mounted between both end walls 18 and 20 of the developing housing 12, and a spiral vane 442 formed in the axial direction of the rotary shaft 441, i.e., in the direction of width thereof. They are made of a suitable plastic material in a unitary structure. The rotary shaft 441 constituting the first stirring/conveying means 44 is protruded rearward penetrating through the rear end wall 20 of the developing housing 12. An input gear (not shown) is secured to the protruded end of the rotary shaft 441 and is coupled to the drive mechanism (not shown) that drives the developing agent application means. The thus constituted second stirring/conveying means 44 is rotated in a direction indicated by an arrow 440 in FIG. 1, and conveys the developing agent from the back side toward the front side as indicated by an arrow in FIG. 2 while stirring the developing agent that is conveyed by the first stirring/conveying means 42 from the front side toward the back side.

The third stirring/conveying means 46 is disposed close to, and in parallel with, the first developing agent application means 24 and the third developing agent application means 28. The third stirring/conveying means 46 comprises a rotary shaft 461 rotatably mounted between both end walls 18 and 20 of the developing housing 12, a cylindrical member 462 mounted on the rotary shaft 461 and a plurality of paddles 463 protruding from the cylindrical member 462. They are made of a suitable plastic material in a unitary structure. The rotary shaft 461 constituting the third stirring/conveying means 46 is protruded rearward penetrating through the rear end wall 20 of the developing housing 12. An input gear (not shown) is secured to the protruded end of the rotary shaft 461 and is coupled to the drive mechanism (not shown) that drives the developing agent application means. The thus constituted third stirring/conveying means 46 is rotated in a direction indicated by an arrow 460 in FIG. 1, stirs the developing agent conveyed by the second stirring/conveying means 44 from the back side toward the front side as indicated by the arrow in FIG. 2 and the developing agent conveyed by the third developing agent application means 28, and feeds the thus stirred developing agent to the first developing agent application means 24.

With further reference to FIG. 1, a circular opening 141 is formed in a predetermined position in the bottom wall 14 of the developing housing 12 under the second stirring/conveying means 44. In the opening 141 is disposed a detector 52 for detecting the concentration of the toner in the developing agent 50 that comprises carrier particles and the toner accommodated in the developing housing 12. The detector 52 may be a widely known one that is exposed in the developing housing 12 through the opening 141 and detects the concentration of the toner in the developing agent 50 by detecting the permeability of the developing agent 50 present on the upper surface thereof. According to the toner concentration in the developing agent 50 detected by the detector 52, the apparatus 10 for developing electrostatic latent image is fed with new toner from a toner feeder means that is not shown. When the toner concentration in the developing agent detected by the detector 52 becomes below a predetermined value, the toner feeder means that is not shown is actuated, and the new toner is allowed to fall on an end portion on the front side (on the left end in FIG. 2) of the first stirring/conveying means 42 in the developing housing 12. When the toner concentration detected by the detector 52 exceeds the predetermined value, the toner conveying means that is not shown ceases to operate, and the supply of toner into the developing housing 12 is interrupted.

Next, the actions and effects of the apparatus 10 for developing electrostatic latent image will be summarized. The toner falls from the toner feeder means (not shown) on the end portion on the front side of the first stirring/conveying means 42, mixed into the developing agent 50 in the developing housing 12, stirred by the action of the spiral vane 422 constituting the first stirring/conveying means 42, and is conveyed from the front side toward the back side (from the end on the left side toward the end on the right side in FIG. 2). The developing agent conveyed by the first stirring/conveying means 42 from the front side toward the back side is transferred, at the end on the back side, to the end on the back side of the second stirring/conveying means 44, and while being stirred by the action of the spiral vane 442 constituting the second stirring/conveying means 44, is conveyed from the back side toward the front side (from the end on the right side toward the end on the left side in FIG. 2). The developing agent conveyed by the second stirring/conveying means 44 from the back side toward the front side is transferred, at the end on the front side, to the end on the front side of the first stirring/conveying means 42 and is circulated. The developing agent conveyed by the second stirring/conveying means 44 from the back side toward the front side as described above, is stirred and pushed up by the paddles 463 of the third stirring/conveying means 46, and is sent toward the first developing agent application means 24.

With further reference to FIG. 1, the first sleeve member 241 of the first developing agent application means 24 is rotated in the direction indicated by the arrow 240. In a developing agent-scooping zone designated at 244 in FIG. 1, the developing agent stirred and pushed up by the paddles 463 of the third stirring/conveying means 46 as described above, is partly scooped onto the peripheral surface of the first sleeve member 241 due to a magnetic field formed by the first magnet means 242. The developing agent scooped onto the peripheral surface of the first sleeve member 241 is caused to move in the direction indicated by the arrow 240 with the rotation of the first sleeve member 241. The ear-cutting plate 300 constituting the ear-cutting means 30 acts on the developing agent that is moved, being magnetically held, on the peripheral surface of the first sleeve member 241 so as to remove an excess of the developing agent from the first sleeve member 241, whereby the thickness of the developing agent layer is properly limited to hold it on the peripheral surface of the first sleeve member 241. When the first sleeve member 241 moves, the developing agent held on the peripheral surface of the first sleeve member 241 passes through the gap (G1) at the position where the first sleeve member 241 constituting the first developing agent application means 24 and the second sleeve member 261 constituting the second developing agent application means 26 are nearest to each other, and is partly transferred onto the peripheral surface of the second sleeve member 261 due to the magnetic field formed by the second magnet means 262 of the second developing agent application means 26. Here, since the gap (G1) at the position where the first sleeve member 241 and the second sleeve member 261 are nearest to each other has been set to be 2.0 to 4.0 mm, which value permits about one-half of the developing agent magnetically adsorbed to, and held by, the peripheral surface of the first sleeve member 241 to be transferred onto the peripheral surface of the second sleeve member 261, about one-half of the developing agent magnetically adsorbed to, and held by, the peripheral surface of the first sleeve member 241 is transferred onto the peripheral surface of the second sleeve member 261 after having passed through the gap (G1).

The developing agent transferred onto, and magnetically held by, the peripheral surface of the second sleeve member 261 constituting the second developing agent application means 26, moves with the rotation of the second sleeve member 261 in the direction indicated by the arrow 260; i.e., the developing agent moves passing through the upstream portion (upper portion in FIG. 1) of the developing zone 6. Accordingly, the developing agent held on the surface of the second sleeve member 261 rubs the peripheral surface of the photosensitive material drum 2 in the upstream portion of the developing zone 6, to develop the electrostatic latent image formed on the peripheral surface of the photosensitive material drum 2.

On the other hand, the developing agent that as maintained magnetically held on the peripheral surface of the first sleeve member 241 without being transferred onto the peripheral surface of the second sleeve member 261, moves with the rotation of the first sleeve member 241 in the direction indicated by the arrow 240; i.e., the developing agent moves passing through the central portion of the developing zone 6. The developing agent held on the peripheral surface of the first sleeve member 241 rubs the peripheral surface of the photosensitive material drum 2, to develop the electrostatic latent image formed on the peripheral surface of the photosensitive material drum 2.

With movement of the first sleeve member 241, the developing agent held on the peripheral surface of the first sleeve member 241 constituting the first developing agent application means 24 and having passed through the developing zone 6, passes through the gap (G2) at the position where the first sleeve member 241 and the third sleeve member 281 constituting the third developing agent application means 28 are nearest to each other, and is transferred onto the peripheral surface of the third sleeve member 281. That is, the first magnet means 242 constituting the first developing agent application means 24 is provided with the developing agent-peeling zone 243 at a position where the first sleeve member 241 and the third sleeve member 281 face to each other with the consequence that the developing agent magnetically held by the peripheral surface of the first sleeve member 241 is peeled off from the peripheral surface of the first sleeve member 241 as it passes through the developing agent-peeling zone 243, and is transferred onto the peripheral surface of the third sleeve member 281 due to the magnetic field formed by the third magnet means 282 of the third developing agent application means 28. At this time, he layer of the developing agent magnetically held on the peripheral surface of the first sleeve member 241 tends to have a thickness which is greater than one-half of the above-mentioned gap (G1) due to the centrifugal force produced by the rotation of the first sleeve member 241 and gravity and hence, the developing agent is transferred onto the peripheral surface of the third sleeve member 281 on the side closer to the photosensitive material drum 2 than the position where the first sleeve member 241 and the third sleeve member 281 are nearest to each other. Here, the gap (G2) at the position where the first sleeve member 241 and the third sleeve member 281 are nearest to each other, has been set to be from one-third to one-half of the gap (G1) which value permits the developing agent magnetically adsorbed to, and held by, the peripheral surface of the first sleeve member 241 to be all transferred onto the peripheral surface of the third sleeve member 281. Therefore, the developing agent magnetically adsorbed to, and held by, the peripheral surface of the first sleeve member 241 is all transferred onto the peripheral surface of the third sleeve member 281.

The developing agent transferred onto, and magnetically held by, the peripheral surface of the third sleeve member 281 constituting the third developing agent application means 28, moves with the rotation of the third sleeve member 281 in the direction of the arrow 280; i.e., the developing agent moves passing through the downstream portion (lower portion in FIG. 1) of the developing zone 6.

Accordingly, the developing agent held by the surface of the third sleeve member 281 rubs the peripheral surface of the photosensitive material drum 2 in the downstream portion of the developing zone 6, to develop the electrostatic latent image formed on the peripheral surface of the photosensitive material drum 2.

As described above, the electrostatic latent image formed on the peripheral surface of the photosensitive material drum 2 receives the developing action of the second developing agent application means 26 in the upstream portion of the developing zone 6, receives the developing action of the first developing agent application means 24 in the central portion of the developing zone 6 and then, receives the developing action of the third developing agent application means 28 in the downstream portion of the developing zone 6, whereby it is developed into a toner image. In the illustrated embodiment, the developing agent is scooped by the first developing agent application means 24 disposed in the central portion of the developing zone 6 and is limited to a proper thickness of the layer by the ear-cutting means 30. The developing agent is then so conveyed that nearly one.-half thereof is transferred to the second developing agent application means 26 to impart the developing action in the upstream portion of the developing zone 6, that the developing agent that has not been transferred onto the second developing agent application means 26 but has been maintained held by the first developing agent application means 24 imparts the developing action in the central portion of the developing zone 6, and is then conveyed to the third developing agent application means 28 to impart the developing action in the lower portion of the developing zone 6. Therefore, the developing agent is favorably conveyed.

The developing agent that has passed through the developing zone 6 being held on the peripheral surface of the third sleeve member 281 constituting the third developing agent application means 28, is peeled off from the peripheral surface of the third sleeve member 281 and is mixed into the developing agent that has been stirred and conveyed by the paddles 463 of the third stirring/conveying means 46, since the magnetic attraction force does not substantially exist or exists slightly in the developing agent-peeling zone 283 and since the developing agent that has been stirred and conveyed by the paddles 463 of the third stirring/conveying means 46 acts on the peripheral surface of the third sleeve member 281 in the developing agent-peeling zone 283. In the illustrated embodiment, the third magnet means 282 constituting the third developing agent application means 28 is not magnetized on the rear side from the line that connects the center thereof with the center of the first magnet means 242 constituting the first developing agent application means 24, i.e., is not magnetized on the side of the developing agent stirring/conveying mechanism 40. Accordingly, the developing agent is not scooped up by the third sleeve member 281. Therefore, the developing agent sent by the paddles 463 of the third stirring/conveying means 46 is scooped up by only the first sleeve member 241 constituting the first developing agent application means 24, and is prevented from being deteriorated in an early time. In addition, the first sleeve member 241 and the third sleeve member 281 can be driven with a decreased torque.

The developing agent that has passed through the developing zone 6 being held on the peripheral surface of the second sleeve member 261 of the second developing agent application means 26, is peeled off from the surface of the second sleeve member 261 since the magnetic attraction force does not substantially exist or slightly exists in the developing agent-peeling zone 263 located on the downstream side of the developing zone 6 as viewed in the direction in which the second rotary sleeve member 261 rotates. The developing agent that has been peeled off from the surface of the second sleeve member 261 is transferred onto the peripheral surface of the sleeve member 321 due to the magnetic field formed by the magnet means 322 constituting the magnetic transfer means 32. In order that the developing agent held on the surface of the second sleeve member 261 is reliably transferred onto the peripheral surface of the sleeve member 321, it is important that the developing agent-peeling zone 263 formed in the second magnet means 262 constituting the second developing agent application means 26 is located, as shown in FIG. 3, on the upstream side, in the direction in which the second sleeve member 261 rotates, of the position P where the second sleeve member 261 constituting the second developing agent application means 26 and the sleeve member 321 of the magnetic conveyer means 32 are nearest to each other, and that the magnet means 322 constituting the magnetic transfer means 32 is magnetized to form an S-pole at a position facing to the developing agent-peeling zone 263 in the second magnet means 262, the S-pole having a polarity opposite to that of the N-N poles forming the developing agent-peeling zone 263. According to experiment conducted by the present inventors, it has been revealed that when the developing agent-peeling zone 263 is formed across the position P where the second sleeve member 261 and the sleeve member 321 are nearest to each other, the developing agent held on the peripheral surface of the second sleeve member 261 partly passes through between the second sleeve member 261 and the sleeve member 321 due to the action of gravity. Furthermore, when the developing agent-peeling zone 263 is formed on the upstream side, in the direction in which the second sleeve member 261 rotates, of the position P where the second sleeve member 261 and the sleeve member 321 are nearest to each other, and when the magnet means 322 constituting the magnetic transfer means 32 is magnetized to form an S-pole at a position facing to the position P that is nearest to the developing agent-peeling zone 263, the S-pole having polarity opposite to that of the N-N poles forming the developing agent-peeling zone 263, the position where the developing agent held on the peripheral surface of the second sleeve member 261 is transferred to the sleeve member 321 comes close to the position P where the second sleeve member 261 and the sleeve member 321 are nearest to each other. As a result, an increased torque is required for driving the second sleeve member 261 and the sleeve member 321, and the developing agent is easily deteriorated. In the illustrated embodiment, on the other hand, the developing agent-peeling zone 263 formed in the second magnet means 262 constituting the second developing agent application means 26 is located, as shown in FIG. 3, on the upstream side, in the direction in which the second sleeve member 261 rotates, of the position P where the second sleeve member 261 constituting the second developing agent application means 26 and the sleeve member 321 of the magnetic conveyer means 32 are nearest to each other, and the magnet means 322 constituting the magnetic conveyer means 32 is magnetized to form an S-pole at a position facing to the developing agent-peeling zone 263 of the second magnet means 262, the S-pole having polarity opposite to that of the N-N poles forming the developing agent-peeling zone 263. Accordingly, the two sleeve members are driven without requiring an increased torque, and the developing agent conveyed by being magnetically adsorbed to the peripheral surface of the second sleeve member 261 constituting the second developing agent application means 26, is reliably transferred onto the sleeve member 321 of the magnetic conveyer means 32.

The developing agent transferred onto the peripheral surface of the sleeve member 321 constituting the magnetic conveyer means 32 is then conveyed by being magnetically adsorbed to the peripheral surface of the sleeve member 321 that rotates in the direction of the arrow 320, and is peeled off from the peripheral surface of the sleeve member 321 in the developing agent-peeling zone 323 formed on the upstream side of a position that faces to the developing agent return guide plate 34. The developing agent that has been peeled off from the peripheral surface of the sleeve member 321 is sent onto the developing agent return guide plate 34 due to centrifugal force produced by the rotation of the sleeve member 321 and the action of gravity. The developing agent sent onto the developing agent return guide plate 34 is guided by the inclined portion 342 and is guided to the upper side of the first stirring/conveying means 42 on the upstream side of the developing agent stirring/conveying mechanism 40, and falls down. Thus, the developing agent that has passed through the developing zone 6 being held by the peripheral surface of the second sleeve member 261 of the second developing agent application means 26, is returned to the upstream side of the developing agent stirring/conveying mechanism 40 through the magnetic conveyer means 32 and the developing agent return guide plate 34, and is reliably stirred and mixed with the developing agent in the developing housing 12 and the new toner fed onto the first stirring/conveying means 42, and is used again for the developing. In the illustrated embodiment, the magnetic conveyer means 32 is disposed between the second developing agent application means 26 and the developing agent return guide plate 34. This makes it possible to increase the angle of inclination of the inclined portion 342 constituting the developing agent return guide plate 34 and hence, to reliably return the developing agent to the upstream side of the developing agent stirring/conveying mechanism 40.

In the developing agent-peeling zone 323 of the magnetic conveyer means 32, it is desired that no magnetic attraction force for adsorbing the developing agent is produced by the magnet means 322. According to experiment conducted by the present inventors, however, it has been revealed that the magnetic force of 50 to 400 gausses is produced at a position facing to the developing agent return guide plate 34. When the magnetic force exists in the developing agent-peeling zone 323, the developing agent is magnetically adsorbed to the peripheral surface of the sleeve member 321 of the magnetic conveyer means 32. When the gap (G5) is great between the sleeve member 321 and the developing agent return guide plate 34, therefore, the developing agent adsorbed to the peripheral surface of the sleeve member 321 is not reliably peeled off and may fall passing through the gap (G5). That is, the carrier particles in the developing agent adsorbed to the peripheral surface of the sleeve member 321 are magnetized by the magnet means 322, whereby the carrier particles are bonded together like a chain due to the magnetic force. The bonding force among the carrier particles away from the peripheral surface of the sleeve member 321 decreases with an increase in the number of the carrier particles that are bonded like a chain. When the gap (G5) is large, therefore, the carrier particles bonded like a chain, as shown in FIG. 4, are cut by the developing agent return guide plate 34; i.e., the developing agent is not all peeled off from the peripheral surface of the sleeve member 321. On the other hand, when the gap (G5) is decreased to reliably peel the developing agent off the peripheral surface of the sleeve member 321, an increased force is required for driving the sleeve member 321. In the illustrated embodiment, therefore, the gap (G5) is set to be 10 to 30 times as great as the diameter of the carrier particles of the developing agent that is used, i.e., set to be (diameter of carrier particle $\times 10 \leqq$ G5 $\leqq$ diameter of carrier particle$\times 30$).

EXAMPLE 1

In the illustrated apparatus for developing electrostatic latent image, an experiment was conducted by selecting the diameter of the sleeve member 321 constituting the magnetic conveyer means 32 to be 24 mm and by selecting the peripheral speed thereof to be 750 mm/sec. The magnetic force of the magnet means 322 was 300 gausses on the peripheral surface of the sleeve member 321 at a position facing to the developing agent return guide plate 34. By changing the width of the gap (G5) between the sleeve member 321 and the developing agent return guide plate 34, the peeling factor of the developing agent magnetically adsorbed to, and held by, the peripheral surface of the sleeve member 321 by the developing agent return guide plate 34 and the torque for driving the sleeve member 321 were measured to obtain the results shown in FIG. 5. The carrier particles in the developing agent used here had an average diameter of 60 $\mu$m.

Figure 5:
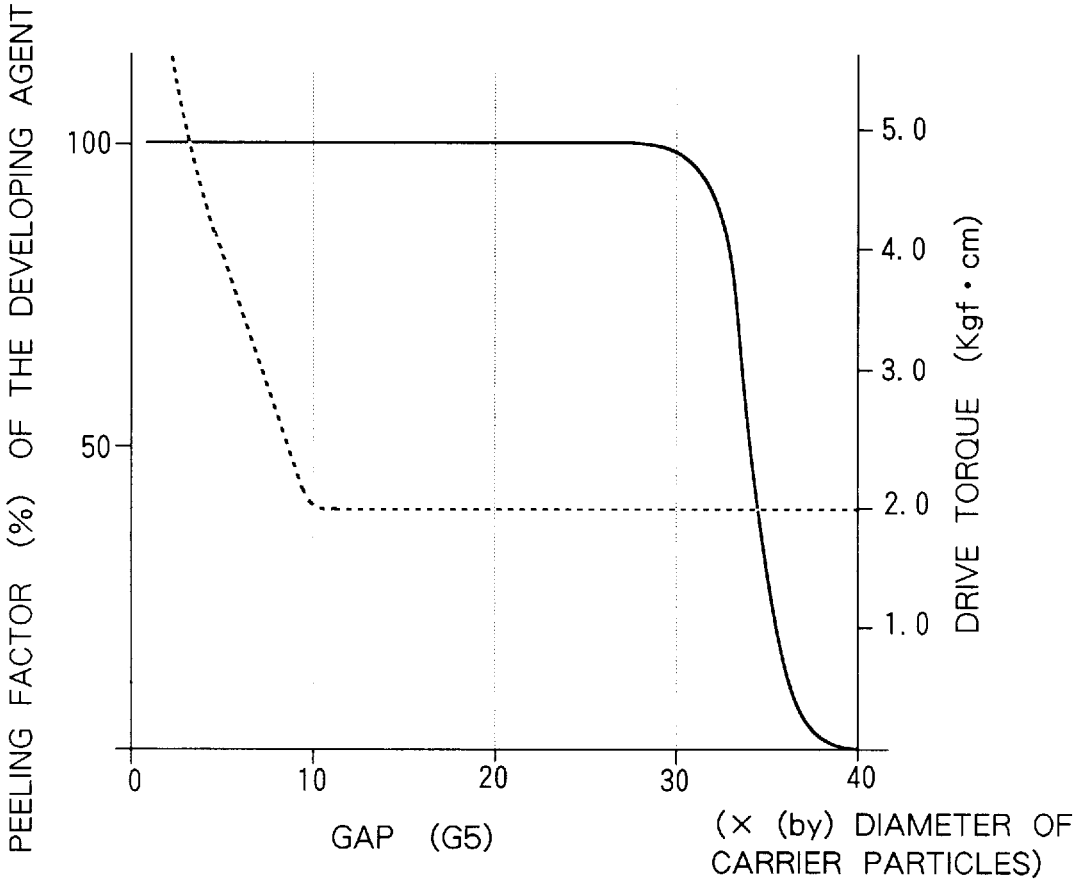
FIG. 5 is a diagram illustrating a relationship among the gap between the developing agent return guide plate and the second sleeve member constituting the second developing agent application means in the apparatus for developing an electrostatic latent image shown in FIG. 1, the developing agent peeling factor by the developing agent return guide plate, and the torque for driving the second sleeve member.

As indicated by a solid line in FIG. 5, it will be understood that the developing agent magnetically adsorbed to the peripheral surface of the sleeve member 321 is peeled off by nearly 100% by the developing agent return guide plate 34 when the gap (G5) does not exceed 30 times the diameter of the carrier particles, but the developing agent peeling factor by the developing agent return guide plate 34 drops sharply when the gap (G5) exceeds 30 times the diameter of the carrier particles. When the gap (G5) becomes smaller than 10 times the diameter of the carrier particles, on the other hand, it is seen that the torque for driving the sleeve member 321 increases steeply as represented by a broken line in FIG. 5. From the foregoing, it is concluded that the gap (G5) is desired to be set to be from 10 to 30 times the diameter of the carrier particles in the developing agent that is used.

Next, another embodiment of the apparatus for developing electrostatic latent image constituted according to the present invention will be described with reference to FIG. 6. The same members as those of the embodiment shown in FIGS. 1 and 2 are denoted by the same reference numerals but their description is not repeated.

Figure 6:
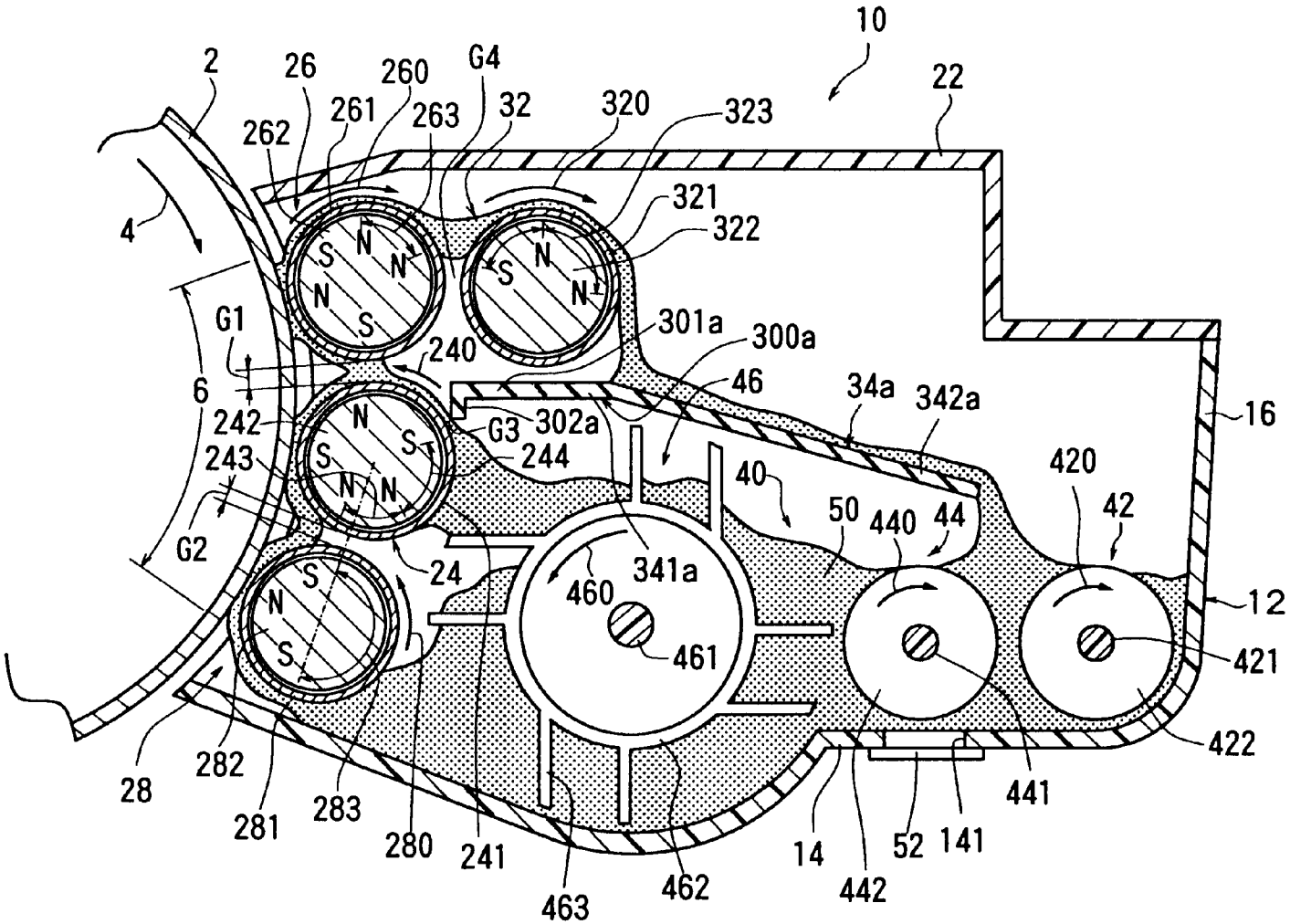
FIG. 6 is a sectional view illustrating the apparatus for developing an electrostatic latent image constituted according to another embodiment of the present invention.

In the apparatus for developing an electrostatic latent image of the embodiment shown in FIG. 6, the ear-cutting plate 300*a* constituting the ear-cutting means and the developing agent return guide plate 34*a* are arranged on the lower side of the magnetic conveyer means 32. In the illustrated embodiment, the ear-cutting plate 300*a* and the developing agent return guide plate 34*a* are made of an aluminum alloy as a unitary structure. The ear-cutting plate 300*a* extends in the direction of width thereof (direction perpendicular to the surface of the paper in FIG. 6) along the first developing agent application means 24, and includes a horizontal portion 301*a* and an ear-cutting portion 302*a* that is downwardly bent nearly at a right angle at an end on the side (left side in FIG. 1) of the first developing agent application means 24. The front edge of the ear-cutting portion 302*a* constituting the ear-cutting plate 300*a* is disposed close to the peripheral surface of the first sleeve member 241 on the upstream side of the developing zone 6 as viewed in the direction in which the first sleeve member 241 constituting the first developing agent application means 24 rotates (in a direction indicated by an arrow 240) and on the upstream side of a position where the first sleeve member 241 and the second sleeve member 261 face to each other. In the same manner as in the embodiment shown in FIGS. 1 and 2, the gap (G3) between the front edge of the ear-cutting portion 302*a* constituting the ear-cutting plate 300*a* and the peripheral surface of the first sleeve member 241 is set to be from about 0.5 to about 1.0 mm, like in the embodiment shown in FIGS. 1 and 2. The developing agent return guide plate 34*a* is constituted by a horizontal portion 341*a* continuous to the rear end of the horizontal portion 301*a* of the ear-cutting plate 300*a* and an inclined portion 342*a* downwardly inclined from the rear end (right end in FIG. 1) of the horizontal portion 341*a*. The lower end of the inclined portion 342*a* constituting the developing agent return guide plate 34*a* is positioned over the upstream side of the developing agent stirring/conveying mechanism 40 that will be described later. In the illustrated embodiment, the ear-cutting plate 300*a* and the developing agent return guide plate 34*a* are constituted as an unitary structure contributing to decreasing the number of parts.

Figure 2:
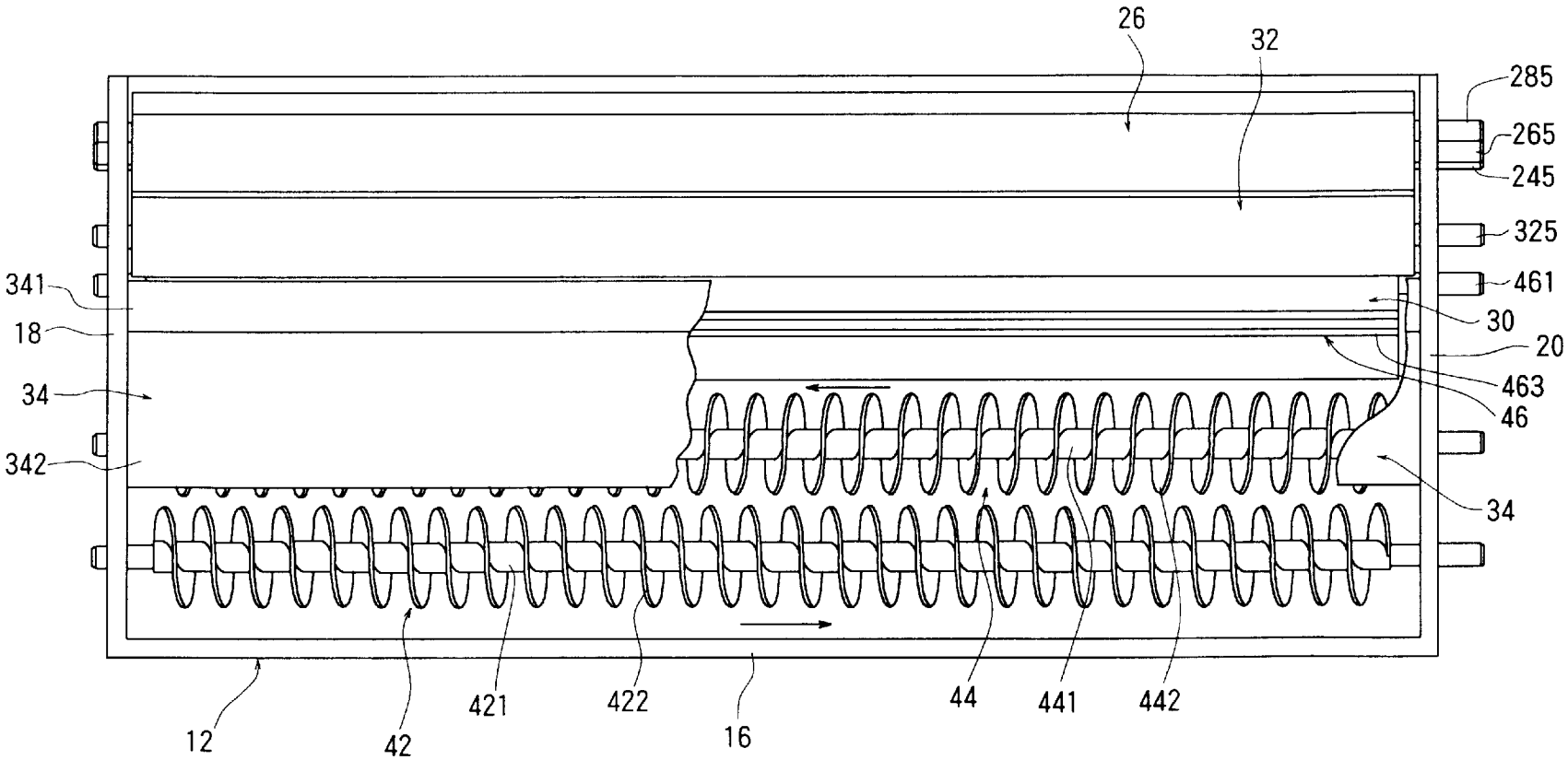
FIG. 2 is a plan view showing, partly in a cut-away manner, the apparatus for developing an electrostatic latent image shown in FIG. 1, in which a cover member that covers the upper surface of a developing housing is omitted.
Figure 3:
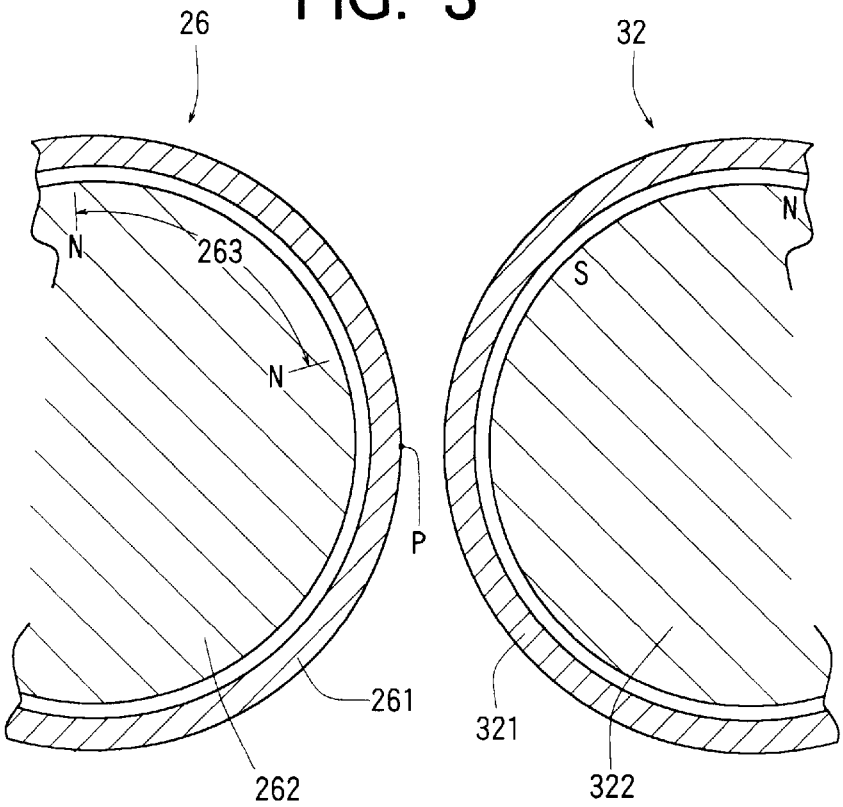
FIG. 3 is a view illustrating a relationship of magnetized positions between a second magnet means constituting a second developing agent application means and a magnet means constituting a magnetic conveyer means in the apparatus for developing an electrostatic latent image shown in FIG. 1.

The actions of the first stirring/conveying means 42, second developing agent application means 26, third developing agent application means 28 and developing agent stirring/conveying mechanism 40 in the thus constituted apparatus 10 for developing electrostatic latent image, are the same as those of the embodiment shown in FIGS. 1 and 2.

Like in the above-mentioned embodiment shown in FIGS. 1 and 2, the developing agent is peeled off from the peripheral surface of the second sleeve member 261 of the second developing agent application means 26, transferred onto the peripheral surface of the sleeve member 321 constituting the magnetic conveyer means 32, conveyed by being magnetically adsorbed to the peripheral surface of the sleeve member 321 rotating in a direction indicated by an arrow 320, peeled off from the peripheral surface of the sleeve member 321 in the developing agent-peeling zone 323 due to the centrifugal force produced by the rotation of the sleeve member 321 and the action of gravity, and is sent onto the developing agent return guide plate 34*a*. The developing agent sent onto the developing agent return guide plate 34*a* is guided by the inclined portion 342*a*, guided to the upper side of the first stirring/conveying means 42 on the upstream side of the developing agent stirring/conveying mechanism 40, and falls down. Thus, the developing agent that has passed through the developing zone 6 being held by the peripheral surface of the second sleeve member 261 of the second developing agent application means 26, is returned to the upstream side of the developing agent stirring/conveying mechanism 40 through the magnetic conveyer means 32 and the developing agent return guide plate 34*a*. Thus, the developing agent is stirred and mixed with the developing agent in the developing housing 12 and with a new toner fed onto the first stirring/conveying means 42, so as to be used again for the developing. In the illustrated embodiment, the developing agent conveyed by being magnetically adsorbed to the peripheral surface of the sleeve member 321 constituting the magnetic conveyer means 32, is peeled off from the peripheral surface of the sleeve member 321 in the developing agent-peeling zone 323 due to the centrifugal force produced by the rotation of the sleeve member 321 and the action of gravity, and is sent onto the developing agent return guide plate 34*a* arranged under the magnetic conveyer means 32. Therefore, the magnetic poles can be easily set to form the developing agent-peeling zone 323. The developing agent on the peripheral surface of the sleeve member 321 constituting the magnetic conveyer means 32 is peeled off in a manner as described above instead of being peeled off by the developing agent return guide plate. Therefore, the developing agent is not deteriorated in an early time, and the sleeve member 321 is driven without requiring an increased torque.

What we claim is:

1. An apparatus for developing an electrostatic latent image formed on the peripheral surface of a photosensitive material drum that moves passing through a developing zone into a toner image by applying a developing agent comprising carrier particles and a toner onto the peripheral surface of said photosensitive material drum in said developing zone, said apparatus for developing the electrostatic latent image comprising:

a developing housing;

a first developing agent application means constituted by a first sleeve member that is arranged in parallel with said photosensitive material drum at the front end in said developing housing and is rotated so as to move in the forward direction relative to the direction in which the peripheral surface of said photosensitive material drum moves in said developing zone, and a first magnet means disposed in said first sleeve member;

a second developing agent application means constituted by a second sleeve member that is arranged in parallel with said photosensitive material drum on the upstream side in a direction in which the peripheral surface of said photosensitive material drum moves relative to said first developing agent application means and is rotated so as to move in a direction opposite to the direction in which the peripheral surface of said photosensitive material drum moves in said developing zone, and a second magnet means disposed in said second sleeve member;

a developing agent stirring/conveying mechanism that is disposed at the back of said first developing agent application means and conveys, while stirring, the developing agent to said first developing agent application means;

a magnetic conveyer means constituted by a sleeve member that is disposed at the back of said second developing agent application means and is rotated in the same direction as said second sleeve member, and a magnet means disposed in said sleeve member; and a developing agent return guide plate that is disposed at the back of said magnetic conveyer means and sends the developing agent conveyed by said magnetic conveyer means, toward the side of said developing agent stirring/conveying mechanism;

wherein said second magnet means constituting said second developing agent application means includes a developing agent-peeling zone having magnetic poles of the same polarity neighboring each other on the upstream side of a position where said second sleeve member and the sleeve member of said magnetic conveyer means are nearest to each other in the direction, in which said second sleeve member rotates; and said magnet means constituting said magnetic conveyer means has a magnetic pole at a position facing to said developing agent-peeling zone formed in said second magnet means, the magnetic pole having a polarity opposite to that of the magnetic poles forming said developing agent-peeling zone.

2. An apparatus for developing an electrostatic latent image formed on the peripheral surface of a photosensitive material drum that moves passing through a developing zone into a toner image by applying a developing agent comprising carrier particles and a toner onto the peripheral surface of said photosensitive material drum in said developing zone, said apparatus for developing the electrostatic latent image comprising:

a developing housing;

a first developing agent application means constituted by a first sleeve member that is arranged in parallel with said photosensitive material drum at the front end in said developing housing and is rotated so as to move in the forward direction relative to the direction in which the peripheral surface of said photosensitive material drum moves in said developing zone, and a first magnet means disposed in said first sleeve member;

a second developing agent application means constituted by a second sleeve member that is arranged in parallel with said photosensitive material drum on the upstream side in a direction in which the peripheral surface of said photosensitive material drum moves relative to said first developing agent application means and is rotated so as to move in a direction opposite to the direction in which the peripheral surface of said photosensitive material drum moves in said developing zone, and a second magnet means disposed in said second sleeve member; and a developing agent stirring/conveying mechanism for conveying, while stirring, the developing agent to said first developing agent application means, the developing agent stirred and conveyed by said developing agent stirring/conveying mechanism being magnetically adsorbed to, and held by, the peripheral surface of said first sleeve member, and part of the developing agent adsorbed to, and held by, the peripheral surface of said first sleeve member being transferred onto the peripheral surface of said second sleeve member and being magnetically adsorbed thereto, and held thereby, so as to be applied onto the peripheral surface of said photosensitive material drum in said developing zone, and the developing agent that has not been transferred onto the peripheral surface of said second developing sleeve member but has been maintained adsorbed to, and held by, the peripheral surface of said first sleeve member, being applied to the peripheral surface of said photosensitive material drum in said developing zone;

wherein at the back of said second developing agent application means is disposed a magnetic conveyer means constituted by a sleeve member that rotates in the same direction as said sleeve member and a magnet means disposed in said sleeve member, at the back of said magnetic conveyer means is disposed a developing agent return guide plate that feeds the developing agent conveyed by being magnetically adsorbed to, and held by, the peripheral surface of said sleeve member to the side of said developing agent stirring/conveying mechanism, and a gap between the front end of said developing agent return guide plate and the peripheral surface of said sleeve member is set to be 10 to 30 times as great as the diameter of the carrier particles.

3. An apparatus for developing an electrostatic latent image formed on the peripheral surface of a photosensitive material drum that moves passing through a developing zone into a toner image by applying a developing agent comprising carrier particles and a toner onto the peripheral surface of said photosensitive material drum in said developing zone, said apparatus for developing the electrostatic latent image comprising:

a developing housing;

a first developing agent application means constituted by a first sleeve member that is arranged in parallel with said photosensitive material drum at the front end in said developing housing and is rotated so as to move in the forward direction relative to the direction in which the peripheral surface of said photosensitive material drum moves in said developing zone, and a first magnet means disposed in said first sleeve member;

a second developing agent application means constituted by a second sleeve member that is arranged in parallel with said photosensitive material drum on the upstream side in a direction in which the peripheral surface of said photosensitive material drum moves relative to said first developing agent application means and is rotated so as to move in a direction opposite to the direction in which the peripheral surface of said photosensitive material drum moves in said developing zone, and a second magnet means disposed in said second sleeve member;

a developing agent stirring/conveying mechanism that is disposed at the back of said first developing agent application means and conveys, while stirring, the developing agent to said first developing agent application means;

an ear-cutting plate disposed along said first developing agent application means, acts on the developing agent that moves being magnetically held by the peripheral surface of said first sleeve member to properly limit the thickness of the layer of the developing agent held on the peripheral surface of said first sleeve member;

a magnetic conveyer means constituted by a sleeve member that is disposed at the back of said second developing agent application means and is rotated in the same direction as said second sleeve member and a magnet means disposed in said sleeve member; and a developing agent return guide plate that is disposed on the lower side of said magnetic conveyer means and sends the developing agent conveyed by said magnetic conveyer means toward the side of said developing agent stirring/conveying mechanism.

4. An apparatus for developing an electrostatic latent image formed on the peripheral surface of a photosensitive material drum that moves passing through a developing zone into a toner image by applying a developing agent comprising carrier particles and a toner onto the peripheral surface of said photosensitive material drum in said developing zone, said apparatus for developing the electrostatic latent image comprising:

a developing housing;

a first developing agent application means constituted by a first sleeve member that is arranged in parallel with said photosensitive material drum in said developing housing and is rotated so as to move in the forward direction relative to the direction in which the peripheral surface of said photosensitive material drum moves in said developing zone, and a first magnet means disposed in said first sleeve member;

a second developing agent application means constituted by a second sleeve member that is arranged in parallel with said photosensitive material drum on the upstream side in a direction in which the peripheral surface of said photosensitive material drum moves relative to said first developing agent application means and is rotated so as to move in a direction opposite to the direction in which the peripheral surface of said photosensitive material drum moves in said developing zone, and a second magnet means disposed in said second sleeve member;

a third developing agent application means constituted by a third sleeve member that is arranged in parallel with said photosensitive material drum on the downstream side in a direction in which the peripheral surface of said photosensitive material drum moves relative to said first developing agent application means and is rotated so as to move in the forward direction relative to the direction in which the peripheral surface of said photosensitive material drum moves in said developing zone, and a third magnet means disposed in said third sleeve member; and a developing agent stirring/conveying mechanism for conveying, while stirring, the developing agent directly to said first developing agent application means; wherein the magnetic poles of said first magnet means, said second magnet means and said third magnet means are so set that the developing agent stirred and conveyed by said developing agent stirring/conveying mechanism is magnetically adsorbed to, and held by, the peripheral surface of said first sleeve member, that part of the developing agent adsorbed to, and held by, the peripheral surface of said first sleeve member is transferred onto the peripheral surface of said second sleeve member and is magnetically adsorbed thereto, and held thereby, and is applied to the peripheral surface of said photosensitive material drum in said developing zone, and that the developing agent that has not been transferred onto the peripheral surface of said second sleeve member but has been maintained adsorbed to, and held by, the peripheral surface of said first sleeve member, is applied onto the peripheral surface of said photosensitive material drum in said developing zone and is, then, adsorbed to, and held by, the peripheral surface of said third sleeve member, and is applied to the peripheral surface of said photosensitive material drum in said developing zone.

5. The apparatus for developing an electrostatic latent image according to claim 4, wherein a gap (G1) at a position where said first sleeve member and said second sleeve member are nearest to each other, is set to a value which permits about one-half of the developing agent magnetically adsorbed to, and held by, the peripheral surface of said first sleeve member to be transferred onto the peripheral surface of said second sleeve member.

6. The apparatus for developing an electrostatic latent image according to claim 5, wherein a gap (G1) at a position where said first sleeve member and said second sleeve member are nearest to each other, is set to be from 2.0 to 4.0 mm.

7. The apparatus for developing an electrostatic latent image according to claim 5, wherein a gap (G2) at a position where said first sleeve member and said third sleeve member are nearest to each other, is set to be from one-third to one-half of said gap (G1).

8. The apparatus for developing an electrostatic latent image according to claim 4, wherein said third magnet means constituting said third developing agent application means is not magnetized in a region on the side of said developing agent stirring/conveying mechanism beyond a line connecting the center thereof with the center of said first magnet means constituting said first developing agent application means.

9. The apparatus for developing an electrostatic latent image according to claim 4, wherein:

the developing agent stirring/conveying mechanism is disposed at the back of said first developing agent application means;

provision is made of a magnetic conveyer means constituted by a sleeve member that is disposed at the back of said second developing agent application means and is rotated in the same direction as said second sleeve member and a magnet means disposed in said sleeve member, and a developing agent return guide plate that is disposed at the back of said magnetic conveyer means and sends the developing agent conveyed by said magnetic conveyer means to the side of said developing agent stirring/conveying mechanism; and the magnet means of said magnetic conveyer means has magnetic poles which are so set that the developing agent conveyed by being magnetically adsorbed to, and held by, the peripheral surface of the second sleeve member, is transferred onto the peripheral surface of said sleeve member and is conveyed by being magnetically absorbed thereto and held thereby, and is peeled off from the peripheral surface of said sleeve member at a position facing to the developing agent return guide plate.

* * * * *